United States Patent [19]

Hauslaib et al.

[11] Patent Number: 4,984,917

[45] Date of Patent: Jan. 15, 1991

[54] LAMINATED PLATEN BAR FOR NOISE ATTENUATION IN MATRIX PRINTERS

[75] Inventors: Wolfgang Hauslaib, Langenau; Guenter Gomoll, Nersingen/Leibi, both of Fed. Rep. of Germany

[73] Assignee: Mannesmann AG, Duesseldorf, Fed. Rep. of Germany

[21] Appl. No.: 926,351

[22] Filed: Oct. 31, 1986

[30] Foreign Application Priority Data

Oct. 31, 1986 [DE] Fed. Rep. of Germany ..... 3538762

[51] Int. Cl.[5] ..... B41J 11/08; B41J 11/053

[52] U.S. Cl. ..... 400/656; 400/661.1

[58] Field of Search ..... 400/689, 661, 661.1, 400/657, 658, 656, 454, 455, 457; 181/207

[56] References Cited

U.S. PATENT DOCUMENTS 1,524,661 2/1925 Kurowski ..... 400/661.1

2,224,083 12/1940 Myers ..... 400/455

3,160,549 12/1964 Caldwell et al. ..... 181/207 X 4,318,452 3/1982 Reitner ..... 400/661 X

FOREIGN PATENT DOCUMENTS 1182862 12/1964 Fed. Rep. of Germany ..... 181/207

OTHER PUBLICATIONS

I.B.M. Technical Disclosure Bulletin, vol. 25, No. 10, Mar. 83, "Platen Assembly", C. Claassen, P. Q. Le and R. Travieso.

*Primary Examiner*—Clifford D. Crowder

*Attorney, Agent, or Firm*—Ralf H. Siegemund

[57] ABSTRACT

The impact and associated noise of matrix printers is attenuated by a laminated platen bar construction comprising a (steel) platen proper, a bonding adhesive layer, a brass bar and a resilient decoupling layer on the platen carrier.

6 Claims, 3 Drawing Sheets

LAMINATED PLATEN BAR FOR NOISE ATTENUATION IN MATRIX PRINTERS

BACKGROUND OF THE INVENTION

The present invention relates to a printer, particularly to a matrix printer in which needles or styli are provided as print elements and including a platen mounted in a frame of the printer, and more particularly the invention relates to the construction of such a platen in a printer which attenuates the development of noise both in the ambient air and as propagating in and emerging from various metallic parts themselves.

Printers of the type to which the invention pertains are usually provided for on line operation and in conjunction with a particular input facilities, establishing immediately and directly the subject matter that is to be printed. Simply for reasons of the environment in which they are used, these printers should not be too noisy. Take a simple word processing facility or a ticket printer or other public or private (but not unmanned) situations. The noise, developed by a printer, is usually attributable (primary source) to the impact of the print needles, both during printing, as well as retraction, of such a needle. There is a direct relationship between impact strength and print speed. Moreover, the parts in question are to be made quite strong simply to impart a long use life upon the equipment, but that, in turn, contributes further to the noise level produced by these parts whenever impacting. In addition, a strong print action is required because in many instances not only an original but also a number of copies, for example, five copies, are to be printed simultaneously. This is, for example, the case in document printing, ticket printing or the like.

In investigating the matter, it was found that noise is not only produced by the print styli themselves as impacting upon the print medium, the platen being underneath but also by and in metal parts serving as platen. The vibrations set up and propagating in the platen will usually propagate into the print frame and the housing as a whole, and for reasons of unforeseeable resonance conditions secondary vibrations may be set up.

A printer of the type to which the invention pertains is, for example, shown in German Patent No. 29 28 233. This patent, moreover, is directed towards reducing the noise development. Herein then, the print platen is mounted in noise attenuating mounts made of rubber; this way some attenuation that is developed does indeed obtain. In addition, a certain attenuating weight are provided which is fastened by means of screws to the upper and lower sides of the platen, there being interposed an attenuating foil made of rubber. Such additional weights, however, are very little effective because, for example, shock waves introduced into the platen, propagate, in fact, nearly horizontally, but the particular arrangement of attenuating weights and attenuating foils do in fact very little to attenuate these vibrations.

DESCRIPTION OF THE INVENTION

It is an object of the present invention to provide a new and improved noise and sound attenuation of a print platen, particularly in a matrix printer.

In accordance with the preferred embodiment of the present invention, it is suggested to provide the print platen to be of laminated construction, the lamina running parallel to the longitudinal direction of extension of the platen and thereby become visible as lamina in a cross-section transversely thereto, and wherein a metallic platen support is combined with a platen carrier and a frame to establish a relatively large mass; a noise attenuating layer configuration or stratum assembly is interposed between the platen support and the metallic platen proper or platen bar The attenuating layer structure includes at least one attenuating layer proper, and at least one layer serving as noise frequency decoupling layer; the former is characterized by a relatively large relaxation period while the latter is relatively highly resilient or elastic.

This configuration offers the advantage that particularly shock waves are attenuated in their direction of predominant propagation. Since the origin of the noise results from a shock like force exertion (impact by the print needles during the printing) it is not surprising that the force development covers a rather wide frequency spectrum in which the print frequency itself is just one component, even through a dominating one. The invention is based on the notion that waves will be reflected on impediments which are, in fact, discontinuities in the direction of wave propagation. Owing to the invention, any resulting resonance frequency or frequencies are, in fact, well below the print frequency. The sandwich-like configuration or laminated structure produces internal sound and noise attenuation because internal layers or strata are, in fact, compressed. Basically, the attenuating layer can be made from any kind of material provided the noise losses they establish are high.

In furtherance of the invention, the noise attenuating layer may be comprised of or include a synthetic bonding layer, being arranged between the platen bar and a metallic intermediate layer or bar. Such a synthetic bonding layer converts oscillating energy by a kind of squeezing action on the synthetic layer, the latter being, in fact, interposed between two metal elements. The squeezing action, having a strong noise attenuating effect, results from simultaneous bending and thrust actions. Owing to the relaxation of such a "glue" like synthetic material wherein relocation or dislocation of the molecules occurs quite delayed upon action of force, one uses that relaxation, in fact, in a two-fold manner: bending and thrust. This, in turn, means that relatively thin synthetic layers suffice in order to attenuate a significant portion of internally produced sound.

Still in furtherance of the invention, it is suggested to provide the frequency decoupling layer as a resilient synthetic layer, having a particular spring constant which, in fact, is subject to control.

A practical form of realizing the invention provides a metallic platen bar being bonded by means of an attenuating layer to a metallic intermediate layer (thin plate bar) which, in turn, abuts a decoupling attenuating layer, the latter being situated on the platen support. This five component arrangement permits, in fact, optimum tuning and adjustment, as far as noise attenuation is concerned, as to all relevant parameters. The metallic intermediate layer may be comprised as a thin flat bar made of brass. Tests have revealed that brass is particularly favorable in combination with the two other synthetic layers as outlined above.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to the detailed description of the drawings, FIG. 1 illustrates a printer having a frame 1 being basically comprised of sides or side bars 1*a* which are interconnected by cross bars or the like, 1*b*. A print platen 2 is fastened to the frame 1. A print needle head S moves back and forth along the platen. The needles or styli of the head are energized and actuated for impacting at high speed against the platen 2, there being of course an ink ribbon and at least one print medium interposed. This is the regular matrix print type of operation which is well known and constitutes the background of the invention. The impact against the platen 2 is the primary source of noise to be attenuated.

The platen 2 is constructed basically to be comprised of a relatively large platen carrier 4, a platen bar (or platen proper) 5, and a platen support 6. The support 6 is fastened to the carrier 4 by means of screws or bolts 7. The bar 5 undergoes oscillation on account of oscillation resulting from the print needle movement and impact in the direction of arrow 8 (see also FIG. 2). FIG. 2 shows particularly the cross-section through the platen, the cross section being taken perpendicular to the direction of length extension of the platen 2. The various cross-hatchings in FIG. 2 illustrate the layer and laminate construction and configuration 10 of the platen. Each of the layers is presumed to have a uniform thickness throughout the length extension of the platen, but the thickness for the various stratum elements is not necessarily the same. All layers and stratum elements extend particularly over the entire length of the platen support 6, being of metal, and being fastened at its ends to the frame by means of screws or bolts 7 (see FIG. 3). The platen support 6, the platen carrier 4, and the frame 1, as interconnected by the bolt 7, constitute a relatively large mass (M) which is of advantage for reasons to be explained more fully below. On the other hand, the mass (m) of the platen bar 5 should be comparatively very small.

Figure 1:
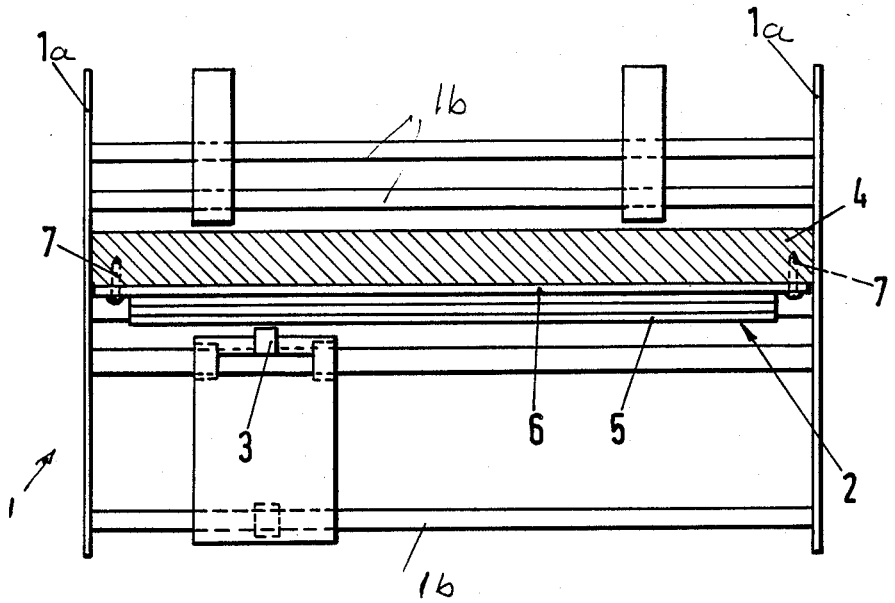
FIG. 1 is a top view of a matrix printer with print needle head and platen serving as an overall view for the environment in which the present invention can be practical.
Figure 2:
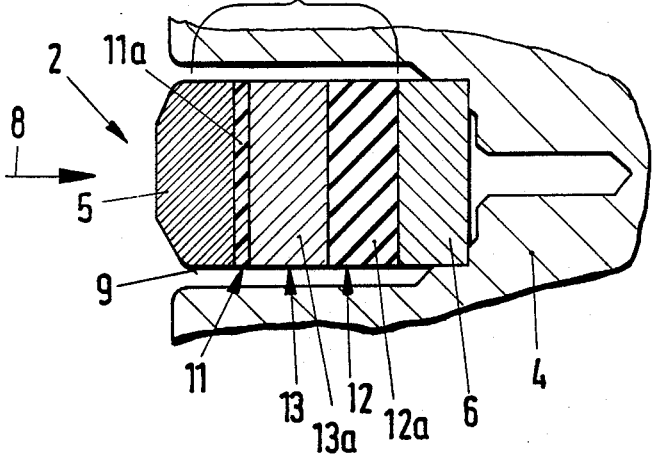
FIG. 2 illustrates a partially cross-section through the platen used in FIG. 1, and illustrating the preferred embodiment of the present invention for practicing the best mode thereof.
Figure 3:
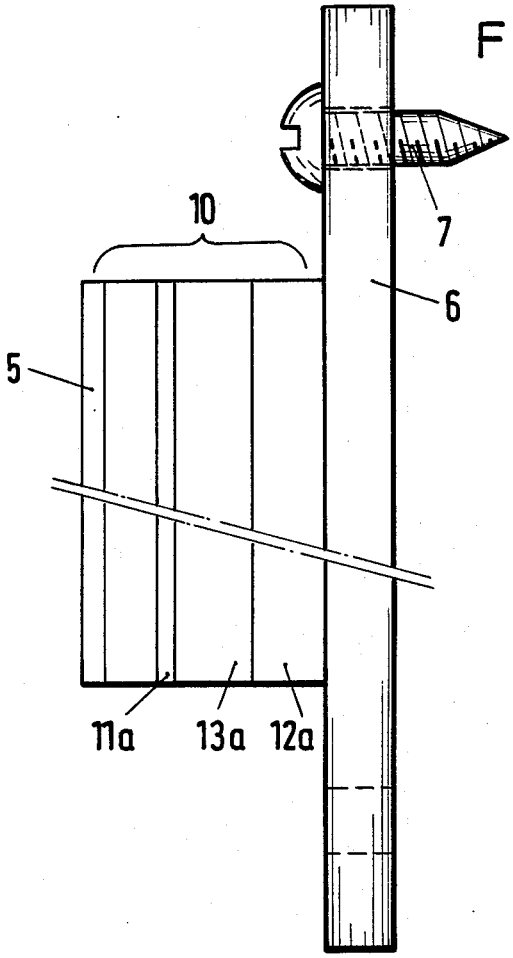
FIG. 3 is a shortened top view of the platen in accordance with FIG. 2.

The laminate construction 10 will be described next. First, there is an attenuating layer 11 provided for purposes of attenuating vibrations and oscillations. This layer 11 is, for example, made of a two component adhesive, made, for example, on the basis of polyurethane. As far as the layer 11 is concerned, it is significant for its function as an attenuating layer, that it be quite soft, owing to it being an adhesive. Moreover, resistance against temperature should be provided for, and is provided for, if the stratum is a polyurethane layer. This temperature resistance is necessary feature because a matrix printer operating for several hours or even on a more or less continuing basis in large data processing systems, will become quite hot.

In addition to the layer 11, a layer 12 is provided which functions to decouple the system from the relevant frequency. This layer is made also of a synthetic material, preferably a polymer but having resilient properties. The two layers 11 and 12 are separated by a thin, flat metallic bar 13 serving as an interconnect layer.

Within the laminate construction 10, bar 5 has a particular mass (m) which is relatively speaking quite small but is considerably increased owing to the addition of attenuating layer 11 and the metallic brass layer 13. The platen bar 5, attenuating layer 11, and the metal layer or bar 13, therefore, establish a relatively large mass m'. Separated from this sub-laminate structure 5, 11, 13 is the resilient attenuating layer 12 being, as stated, made of an elastic polymer. From a point of view of oscillation, one can consider the attenuating layer 12 to be a spring that connects mass m' to mass M. This "spring" resiliently decouples the platen carrier 4 from the platen bar 5. The mass m' of the composite layer 5, 11, and 13 is relatively large as compared with m of 5 alone, but still small as compared With M. The resilient effect and elasticity of the layer 22 provides for a decoupling between that mass m' and the mass M composed of parts 4 and 6. The spring is deemed to be relatively soft in order to lower the resonance frequency.

Figure 4:
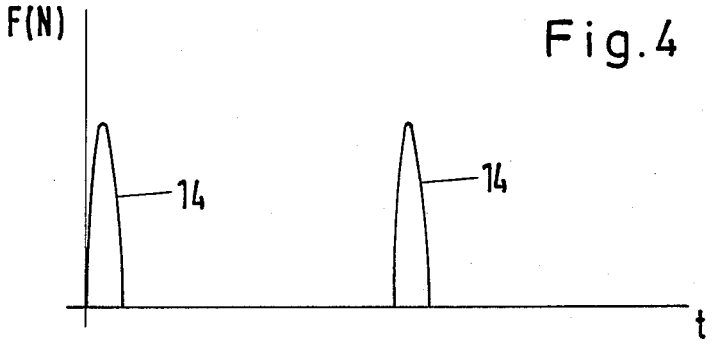
FIG. 4 is a force-time oscillation diagram for the print pulses as they appear in the printer shown in FIG. 1.
Figure 5:
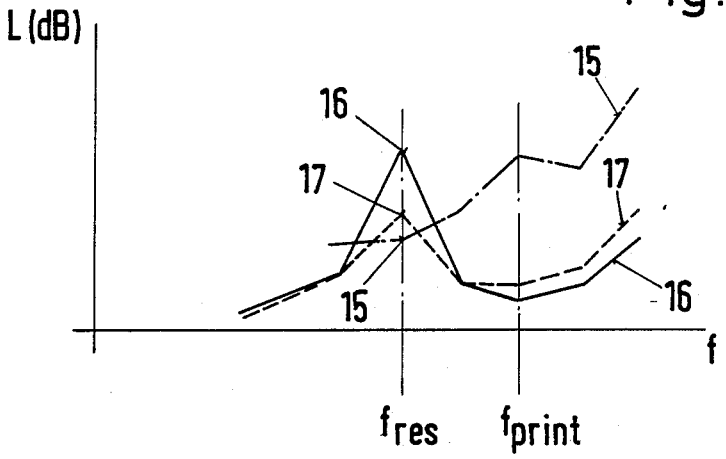
FIG. 5 is a noise level frequency diagram for various kinds of print platen configurations.
Figure 6:
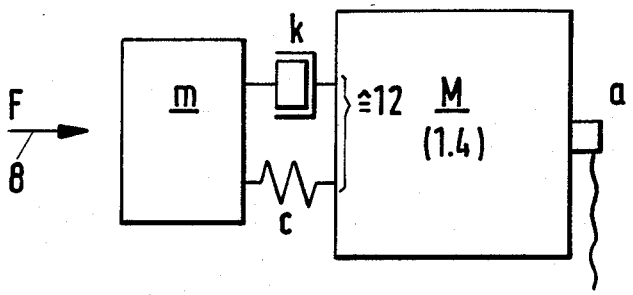
FIG. 6 is a schematic showing of an equivalent circuit diagram involving the representation of features of the invention and of relevant oscillatory parameters.

The oscillating system is comprised of the parts described, and is explained now with reference to FIGS. 4 5, and 6. The forces in platen 2 generally, or the impact forces of the print needles upon the platen in particular, result from local impacts by these needles, the location of impact varies owing to the fact that the head 3 moves from left to right, as well as from right to left across the platen, whereby printing can be obtained in either direction. Accordingly, these impact pulses upon the platen 2 can occur at all times and at variable locations. An impact on the platen near its right end may produce the same local noise spectrum as an impact near the left end, but in terms of over all noise production in the platen structure as a whole the situation is quite different for these two bars. The inventive construction takes up each of these cases and any in between. One can, therefore, consider the fact that the force energization resulting from such an impact covers a relatively broad band frequency spectrum, that may vary as to its effectiveness in any location but the print impact pulses 14, as shown in FIG. 4, have a dominant amplitude and recur at the point frequency. As a consequence, the platen will emit sound into the ambient air, as well as sound waves into the interior of the platen parts which impulses and sound will propagate through the various solid parts in the platen-frame assembly and will, on one hand, set up local oscillation and vibrations of individual parts, which in turn emit sound on their own, while, on the other hand, these internal vibrations are subject to attenuation, owing to the structure and features of the invention.

All these various phenomena produce a noise pattern or spectrum of a matrix printer when operating. This noise, unless attenuated, i.e. unless the features of the invention are used, can be too large, and can be regarded as quite disturbing. FIG. 5 now shows several noise level characteristics in dependence upon frequency with particular emphasis on a resonance frequency as well as the print frequency so identified. These curves have been normalized as to the frequency scale; the print frequency is used as reference point and the normalization is such that the resonance peaks are made to coincide to better permit a comparison of the respective resulting resonance peak reductions (see also the discussion of FIG. 6 below).

The curve 15, for example, represents the noise spectrum produced if the entire platen is one solid body. A resonance frequency is relatively unpronounced and together with the frame constitutes one solid body but the characteristic exhibits a disadvantageous noise level print frequency with an overall tendency of the internal noise to increase at high frequencies. In case the print platen is of a steel-synthetic-steel composite, a frequency characteristic results as shown in trace 16. Here then obtains a relatively high resonance frequency of the platen resonating vis-a-vis a frame-plus-platen support structure which, as was mentioned earlier, is quite a disadvantage.

Trace 17 presents a laminate type of platen basically being a steel-synthetic-brass as per the invention. Here one can see that, particularly as far as the resonance frequency is concerned, the loss is considerably increased. Moreover, the resonance frequency is quite low and the print frequency is quite high. Moreover, it is rather important that the print frequency is much farther from the resonance frequency.

The equivalent circuit shown in FIG. 6 is a simplified representation of the invention. It is assumed that the layer group, being comprised of a platen bar 5, the attenuating layer 11, and the metal layer 13, and together they have a relatively small mass m. The attenuating layer 12 will respond to an attenuating factor k and a spring c. The frame 1 and carrier 4 together have a relatively large mass M. This kind of an oscillating system follows certain laws from which one can calculate the resonance frequency frees above which the bar 5 (in cooperation with the adjoining strata) seems to attenuate internal vibrations. Reference character a represents a transducer by means of which any accelerations by that mass M have been measured. The measurements are actually the basis for the curves in FIG. 5. It was found that the noise level of a matrix printer equipped as per the present invention amounted to 50 dB.

The invention is not limited to the embodiments described above, but all changes and modifications thereof, not constituting departures from the spirit and scope of the invention, are intended to be included.

We claim:

1. Printer, particularly matrix printer, wherein the print element, needles or styli, are mounted on and being part of a print head moving along a platen, the platen being mounted in a printer frame, the improvement comprising:

said platen being of laminated construction with the layers extending parallel to a longitudinal extension of the platen and transversely to operating directions of the print elements, and including a metallic platen bar, a metallic platen support there being a platen carrier to which said platen support is connected, the platen support, the platen carrier and the frame constituting a relatively large mass, large in comparison with the platen bar; and a first layer provided for attenuating oscillations and serving as an attenuating layer and being interposed between said platen bar and said support, and a further vibratory, decoupling layer being interposed between said support at said attenuating layer, decoupling being with regard to said oscillations as resulting from impacts of the print elements upon the platen.

2. Printer, particularly matrix printer, wherein the print elements, needles or styli, are mounted on and being part of a print head, moving along a platen, the platen being mounted in a printer frame, the improvement comprising:

a platen being of laminate construction and including a metallic platen support, a first, resilient, decoupling and attenuating layer on the platen support, a second, metallic layer on top of the first layer, a third, attenuating, non-resilient layer on top of the second metallic layer, and a platen bar on top of the third, attenuating layer, the platen bar facing the styli or needles.

3. Printer as in claim 2, wherein said first layer is made of a resilient synthetic.

4. Printer as in claim 2, wherein said third layer is an adhesive layer by means of which the metallic platen bar and the second metal layer are bonded to each other.

5. The improvement as in claim 2, wherein said second metal layer is a thin brass bar.

6. Printer as in claim 2, said first layer being a resilient synthetic, the second layer being a brass bar, the third layer being a bonding adhesive synthetic.

* * * * *